United States Patent [19]

Sun Keu

[11] Patent Number: 4,472,110

[45] Date of Patent: Sep. 18, 1984

[54] WIND SHIFTING APPARATUS FOR THE ELECTRIC FAN

[76] Inventor: Pak Sun Keu, 181-6, Nonhyun-Dong, Kangnam-ku, Seoul, D.P.R. of Korea

[21] Appl. No.: 455,541

[22] Filed: Jan. 4, 1983

[51] Int. Cl.[3] ..... F03D 7/06

[52] U.S. Cl. ..... 416/170 R; 416/169 R; 416/100; 416/172

[58] Field of Search ..... 416/170 R, 170 A, 100, 416/171, 169 R, 172

[56] References Cited

U.S. PATENT DOCUMENTS

| | | | |
|---|---|---|---|
| 757,774 | 4/1904 | Roehrich | 416/100 |
| 1,005,429 | 10/1911 | Hollander et al. | 416/100 |
| 1,479,619 | 1/1924 | Martinez | 416/170 |
| 3,625,633 | 12/1971 | Nelson | 416/169 |

FOREIGN PATENT DOCUMENTS

| | | | |
|---|---|---|---|
| 533652 | 12/1954 | Belgium | 416/100 |
| 2507052 | 8/1975 | Fed. Rep. of Germany | 416/100 |
| 580062 | 6/1958 | Italy | 416/100 |

*Primary Examiner*—Kwon John

*Attorney, Agent, or Firm*—Holman & Stern

[57] ABSTRACT

An electric fan and mechanism therefore for controlling the wind direction of the fan upwardly and downwardly and rotationally through 360° as well as 90°. Separate clutch elements are provided with a cooperating clutch pin selectively controlled by a rotatable lever to engage one or the other clutch element, or neither, to regulate the desired rotational movement of the fan.

6 Claims, 5 Drawing Figures

WIND SHIFTING APPARATUS FOR THE ELECTRIC FAN

BACKGROUND OF THE INVENTION

1. Field of the Invention

This invention relates to a wind shifting apparatus for an electric fan wherein the motor of the electric fan is mounted pivotally at the upper end of a supporting pipe standing at the center of the base, a flange pipe being connected with the upper end of the supporting pipe, a gear clutch and clutch being mounted at the upper and lower portions of the outer circumferential surface of the flange tube, a clutch pin cooperating with the gear clutch or the clutch in accordance with the operation of the clutch lever attached at the lower portion of the supporting pipe, and a separate worm being provided at the lower end of the vertical shaft on which the other worm is meshed with the screw formed at the rear portion of the motor shaft.

2. Description of the Prior Art

In a conventional electric fan, the direction of wind can be shifted to turn to the left and the right or upward and downward. However, rotation of the motor through 360° cannot be obtained. Also, in the mechanism for shifting the wind to turn to the left and the right or the upward and downward, bar formed at the bottom face of the motor casing is connected with the upper end of the supporting pipe and there is provided a semi-circular rack at the lower end portion of the bar and a resilient apparatus for controlling the rack at the upper end of the supporting pipe to regulate the direction of wind to turn upward and downward through the interval of the rack. However, the construction of conventional apparatus is complicated and the manufacture thereof is not easy. Furthermore, it is not possible to shift the direction of wind upwardly and downwardly at the same time as the rotation of the motor casing through 360°.

SUMMARY OF THE INVENTION

It is an object of the invention to overcome two above problems in the prior art. In accordance with the invention, there is provided a wind shifting apparatus for an electric fan of the type comprising a gear mounted at the lower end of a short shaft located vertically at the lower portion of the motor case, a pivot shaft provided in the frame, a universal joint connecting the upper end of said pivot shaft with the lower end of the short shaft, a gear meshed with the clutch gear at the lower end of the pivot shaft, an arm connecting an eccentric shaft located at one side of the gear with a clutch pin fixed at a portion of the protrusion plate of the clutch and wear resistent acetal resin washers inserted between the frame brackets formed by bending the rear portion of the frame to be made into the left and right portions and the brackets at the rear portion of the motor whereby said washers cooperate with said brackets by means of shaft bolts and friction bolts.

It is a further object of this invention to provide reciprocating rotation of 90° or 360° of the fan motor in the left and right direction, together with upward and downward regulation of the fan motor, by means of the operation of a clutch lever causing the clutch pin to mate with the cooperating groove of the gear clutch or the cooperating groove of the clutch.

BRIEF DESCRIPTION OF DRAWINGS

The invention will now be described in greater detail with reference to the accompanying drawings wherein.

DETAILED DESCRIPTION

Figure 1:
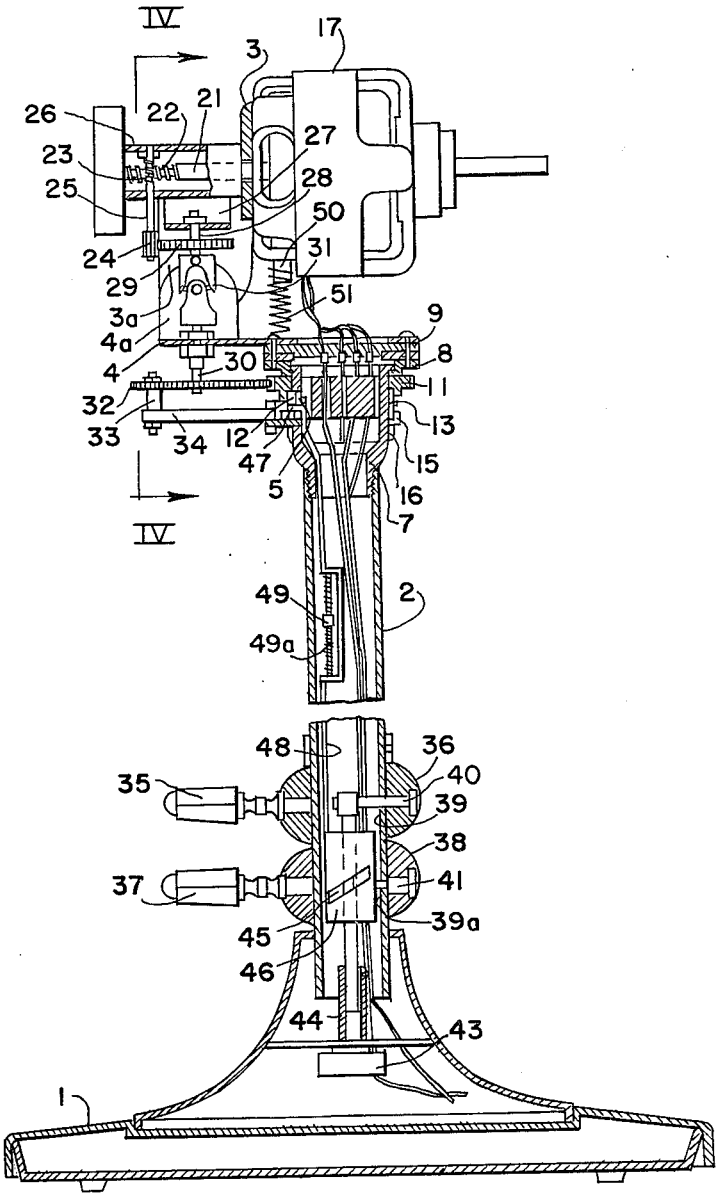
FIG. 1 is a vertically cross-sectional view of the entire electric fan assembly embodying the invention.
Figure 2:
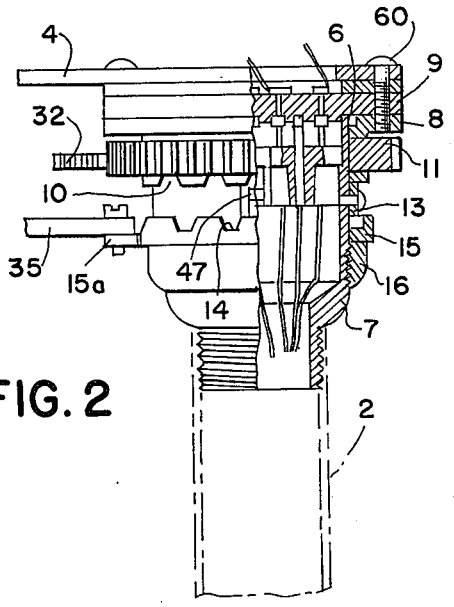
FIG. 2 is a partial cross-sectional view showing the cooperating structural features of the brush plate, the flange and the clutch of FIG. 1.
Figure 3:
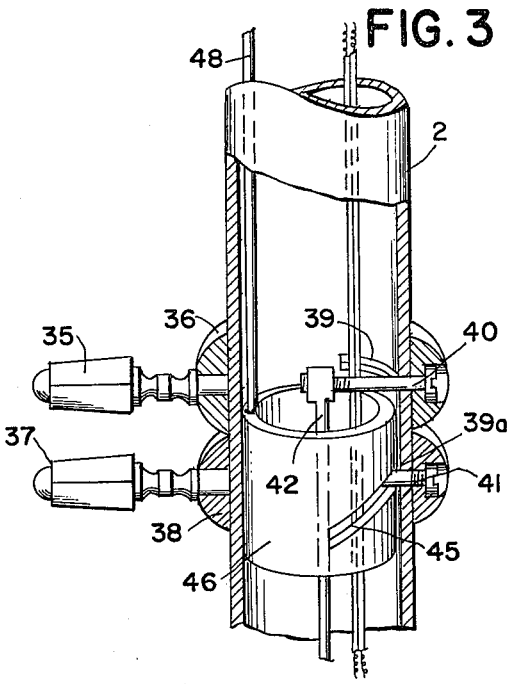
FIG. 3 is a perspective cross-sectional view showing the cooperating structural features of the switch lever, the clutch operating lever and the connecting parts thereof.
Figure 4:
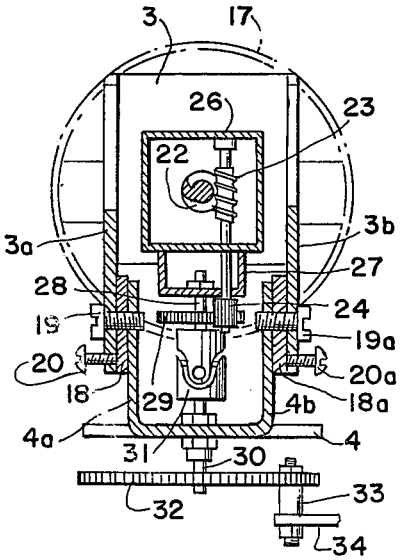
FIG. 4 is a cross-sectional taken along line IV—IV in FIG. 1.

In a the conventional electric fan having a frame 4 mounted at the upper end of a supporting pipe 2 supported at the center of the base 1 and the motor frame 3 mounted on said frame 4, a thread is formed on the outer circumferential surface of the lower end of a flange tube 7 and a vertically extending through hole, or slot, 5 is provided at one side through the circumferential surface of the flange tube. A cooperating screw thread is provided at the upper end of the supporting pipe 2 for the flange tube 7, the latter having an annular protrusion 6 (FIG. 2) extending outwardly at the uppr end portion thereof. A flange 8 mated with the annular protrusion 6 and the metallic brush disc 9 supplying the electricity to the motor are connected together with the frame 4 by bolts 60 to revolve about the central axis of the annular protrusion 6. On the outer circumferential surface of the flange tube 7, below flange 8 a gear clutch 11 having a plurality of cooperating grooves 10 on the lower face thereof is mounted to revolve. A spacer ring 13 having a hole 12 in one side thereof aligned with hole 5 is mounted in flange tube 7 below gear clutch 11. Also, a clutch 15 having a plurality of the cooperating grooves 14 on the upper face thereof is mounted below spacer ring 13 to revolve on flange tube 7 and anchor ring 16 is threadedly engaged under clutch 15.

The motor 17 is mounted on the upper end of the supporting pipe 2 by connecting the brackets **3*a* and 3*b* at the rear portion of the motor frame 3 with the frame brackets 4*a* and 4*b* at the left and right portions of the frame 4. The acetal resin washers 18 and 18*a* having a good wear resistance are inserted between the brackets 3*a* and the frame bracket 4*a* as well as between the bracket 3*b* and the frame bracket 4*b* respectively and are connected together with them by the shaft bolts 19 19*a* so that the motor 17 can be pivoted angularly about such shaft bolts 19 and 19*a*. Also, the friction bolts 20 and 20*a* are threaded into the threaded holes of the brackets 3*a* and 3*b* so that friction action can be obtained between the end portion of the friction bolts 20 and 20*a* and the washers 18 and 18*a*** by pressing the former against the latter.

The shaft 25 is located vertically in the casing 26 and includes the upper worm gear 23, meshed with the worm screw 22 formed at the rear portion of the motor shaft 21, and the separate lower worm 24, which worm screw is known as a portion of the conventional left-right wind shifting apparatus. The gear 29 is fixed on the lower end of the short shaft 28 located vertically in the auxiliary casing 27 formed at the center of the bottom face of the casing 26 and the gear 29 is mated with the worm 24. The lower end of the short shaft 28 and the upper end of the connecting shaft 30 mounted vertically on the frame 4 are connected by the universal joint 31. Gear 32 is mounted at the lower end of the connecting shaft 30 and mated with the gear clutch 11, the gear 32 being larger in diameter than the gear 29. The arm 34 is connected between shaft 33 eccentrically mounted in gear 32 and the protrusion plate 15*a* formed in one side of the clutch 15. Mounted on the lower and outer circumferential surface of the supporting pipe 2 are the rotating ring 36 in which the switch lever 35 is inserted and the rotating ring 38 in which the clutch lever 37 is inserted. The long bolt 40 is screwed from the outer surface of the rotating ring 36 and the short bolt 41 is screwed from the outer surface of the rotating ring 38, extending through the semi-circular slots 39 and 39*a*, respectively, in the supporting pipe 2. The inner end of the long bolt 40 is connected with the upper end of switch operating rod 42 supplying the electricity and the lower end of the switch operating rod 42 is connected with the switch tube 44 of the switch box 43. The inner end of the short bolt 41 is introduced into the inclined slot 45 of the tubular sleeve 46. Formed at the upper end of the clutch operating rod 48 is the clutch pin 47 extending outwardly through the through hole 5 and the hole 12. The lower end of said clutch operating rod 48 is connected with the upper end of the tubular body 46.

Fixed in the U shaped space provided by bending the intermediate portion of the clutch operating rod 48 is the resilient device 49 in which spring 49*a* is inserted into the bolt. A protrusion 50 is formed on the bottom face of the motor 17 and spring 51 inserted at the upper end onto said protrusion is mounted at the lower end on the frame 4 to support the motor 17.

The operation and effectiveness of the invention is as follows.

When the switch lever 35 is rotated, the switch operating rod 42 cooperating with the inner end of the long bolt 40 connects the terminals of the switch box 43 and operates the motor 17. At the same time, if it is desired to rotate the direction of wind from the electric fan through 360°, the clutch lever 37 is rotated to the left, or clockwise as viewed from above, and the tubular body 46 rises along the inclined slot 45 by the camming action of the short bolt 41 so that the clutch operating rod 48 rises accordingly. Clutch pin 47 is thereby introduced into a cooperating groove 10 of the gear clutch 11 preventing it from further rotating. At this time, the gear 32 connected with the universal joint 31 revolves about the outer circumferential surface of the clutch gear 11 and selfrotates at the same time so that the clutch 15 can revolve about the outer circumferential surface of the flange tube 7. Therefore, the motor 17 can revolve about the central axis of the supporting pipe 2 through 360° by means of the operation of the eccentric shaft 33 and the arm 34 thus rotating the direction of wind through 360°.

When the clutch lever 37 turns to the right, or counter-clockwise as viewed from above, through a small angle from the position mentioned above, the clutch pin 47 will be located intermediate the gear clutch 11 and the clutch 15 so that the clutch 15 will revolve about the outer circumferential surface of the flange tube and the motor does not continue to rotate through 360° and the wind is fixed in a certain direction.

Furthermore, when the clutch lever 37 is turned further to the right, the clutch pin 47 is inserted into the cooperating groove 14 of the clutch 15. The gear clutch 11 will then revolve about the outer circumferential surface of the flange tube but the clutch 15 is fixed so that the motor 17 can be rotated alternatively to the left or the right through 90° by means of the rotating operation of the gear 32 connected with the arm 34.

Figure 5:
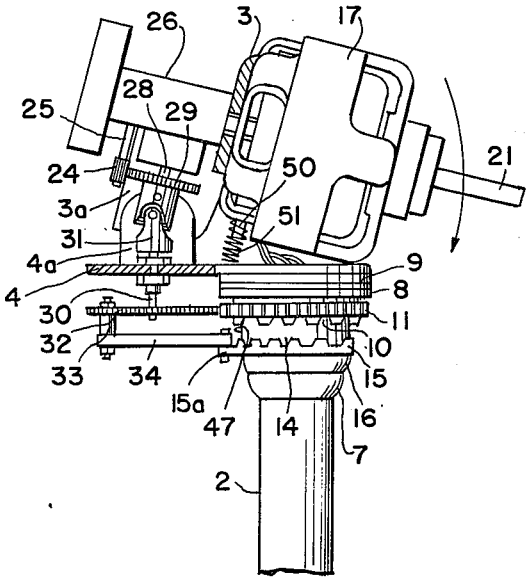
FIG. 5 is an elevational view illustrating the upward and downward wind shifting operation of the electric fan in accordance with the invention.

In addition to the rotation of 360° or 90° of the motor in accordance with the operation mentioned above, the continuous wind shifting operation can be obtained without any difficulty by means of the universal joint 31 although the motor 17 is inclined downwardly (FIG. 5) or upwardly by the friction action of the mounting brackets.

The inclined angle of the motor 17 is maintained by means of the supporting action of the spring 51 and the friction action between the brackets 3*a* and 4*a* and the brackets 3*b* and 4*b* exerted by the pressure of the shaft bolts 19 and 19*a* and the friction bolts 20 and 20*a* so that the inclined angle of the motor 17 can be regulated upwardly and downwardly as desired. Therefore, the advantage can be obtained by the invention wherein the motor 17 can be regulated upwardly and downwardly and rotated arbitrarily through 360° or 90° in any position.

I claim:

1. In an electric fan wherein a fan motor having a motor frame and driven shaft extension extending from the rear is mounted at the upper end of a supporting pipe supported substantially vertically at its lower end in a base member, the improvement comprising a gear transmission supported at the upper end of said supporting pipe and operably engaging said shaft extension to be driven thereby comprising at least one rotatable transmission shaft and a clutch engaging gear mounted thereon, an annular clutch member rotatably mounted about a substantially vertical axis adjacent the upper end of said supporting pipe, a clutch gear on said clutch member operably engaging said clutch engaging gear, a plurality of circumferentially spaced grooves on the lower surface of said clutch member, a vertically extending clutch pin hole through said supporting pipe below said clutch member, a clutch lever rotatably mounted on said supporting pipe below said upper end thereof, a substantially semi-circular slot through the wall of said pipe, a radially extending bolt member attached to said clutch lever extending through said semi-circular slot into the interior of said pipe, a tubular sleeve in the interior of said supporting pipe, an inclined slot through said sleeve operably receiving the inner end of said bolt member so that rotation of said clutch lever moves said sleeve axially within said supporting pipe, a clutch rod within said pipe attached at its lower end to said sleeve and extending upwardly to a position adjacent said clutch pin hole, a clutch pin on the upper end of said clutch rod extending through said clutch pin hole for selectively engaging said grooves on said clutch member so that when said motor shaft is rotated and said clutch pin is raised by said clutch lever into engagement in one of said grooves, said clutch member is held stationary and said fan motor revolves through 360° about the axis of rotation of said clutch member, and when said clutch pin is lowered by said clutch lever out of engagement with said clutch member grooves, said clutch member rotates and said fan motor is stationary.

2. An electric fan as claimed in claim 1 and further comprising a second annular clutch member rotatably mounted on said supporting shaft below said clutch pin hole, a plurality of circumferentially spaced grooves on the upper surface of said second clutch member, a flange on said second clutch member, an eccentric arm pivotally connected at one end to said flange and pivotally connected at the other end to said clutch engaging gear eccentrically with respect to the axis of rotation thereof, so that when said clutch pin is lowered by said clutch lever into engagement with one of said grooves on said second clutch member said second clutch member is held stationary and said eccentric arm causes said clutch engaging gear to revolve about the first mentioned clutch member to rotate said fan motor 90° alternately in opposite directions about the axis of rotation of said first clutch member.

3. An electric fan as claimed in claim 2 and further comprising a support bracket rotatably mounted at the upper end of said supporting pipe, spring means resiliently supporting said fan motor above said support bracket to facilitate tilting of said fan motor through a substantially vertical arc, a U-shaped portion extending upwardly from said support bracket, a motor bracket on said motor frame having an inverted U-shaped portion extending downwardly in overlapping relationship with said U-shaped portion on said support bracket, friction washers inserted between the respective adjacent legs of said overlapping U-shaped brackets, pivot bolts pivotally connecting the legs of said motor frame bracket to the legs of said support bracket, friction adjusting bolts threadedly extending through the legs of said motor frame bracket and frictionally engaging at their inner ends said friction washers to facilitate adjustment of frictional restraint against said tilting of said motor through said substantially vertical arc, and said transmission further comprising a drive worm gear on said driven shaft extension, a substantially vertical worm shaft rotatably supported on said motor frame, a driven worm gear on the upper end of said worm shaft operatively engaging said drive worm gear, a gear on the lower end of said worm shaft, a substantially vertical short shaft rotatably supported at its upper end on said motor frame, a gear fixedly mounted on said short shaft and operatively engaging said gear on the lower end of said worm shaft, a connecting shaft rotatably supported on said support bracket coaxially with said short shaft and having said clutch engaging gear fixedly mounted on the lower end thereof, and a universal joint operatively connecting said connecting shaft to said short shaft, so that said fan motor can be rotated through said 360° or said 90° irrespective of the tilting position of said fan.

4. An electric fan according to claim 3 wherein said spring means is a helical spring adapted to support the weight of the motor and is connected at one end to the bottom face of the motor and at the other end to the upper face of said support bracket so that said spring supports the motor upwardly in order to resiliently resist the downward displacement of the motor due to vibration.

5. An electric fan as claimed in claim 1 and further comprising a support bracket rotatably mounted at the upper end of said supporting pipe, spring means resiliently supporting said fan motor above said support bracket to facilitate tilting of said fan motor through a substantially vertical arc, a U-shaped portion extending upwardly from said support bracket, a motor bracket on said motor frame having an inverted U-shaped portion extending downwardly in overlapping relationship with said U-shaped portion on said support bracket, friction washers inserted between the respective adjacent legs of said overlapping U-shaped brackets, pivot bolts pivotally connecting the legs of said motor frame bracket to the legs of said support bracket, friction adjusting bolts threadedly extending through the legs of said motor frame bracket and frictionally engaging at their inner ends said friction washers to facilitate adjustment of frictional restraint against said tilting of said motor through said substantially vertical arc, and said transmission further comprises a drive worm gear on said driven shaft extension, a substantially vertical worm shaft rotatably supported on said motor frame, a driven worm gear on the upper end of said worm shaft operatively engaging said drive worm gear, a gear on the lower end of said worm shaft, a substantially vertical short shaft rotatably supported at its upper end on said motor frame, a gear fixedly mounted on said short shaft and operatively engaging said gear on the lower end of said worm shaft, a connecting shaft rotatably supported on said support bracket coaxially with said short shaft and having said clutch engaging gear fixedly mounted on the lower end thereof, and a universal joint operatively connecting said connecting shaft to said short shaft, so that said fan motor can be rotated through said 360° irrespective of the tilting position of said fan.

6. An electric fan according to claim 5 wherein said spring means is a helical spring adapted to support the weight of the motor and is connected at one end to the bottom face of the motor and at the other end to the upper face of said support bracket so that said spring supports the motor upwardly in order to resiliently resist the downward displacement of the motor due to vibration.

* * * * *

UNITED STATES PATENT AND TRADEMARK OFFICE

CERTIFICATE OF CORRECTION

PATENT NO. : 4,472,110

DATED : Sept. 18,1984

INVENTOR(S) : Pak Sun Keu

It is certified that error appears in the above—identified patent and that said Letters Patent is hereby corrected as shown below:

Page 1 block [76] should read:

[76] Inventor: Pak Sun Keu, 181-6, Nonhyun-Dong, Kangnam-ku, Seoul, Republic of Korea Signed and Sealed this

*Twenty-sixth* Day of *August 1986*

[SEAL]

*Attest:*

DONALD J. QUIGG

*Attesting Officer*

*Commissioner of Patents and Trademarks*